FIG. 1
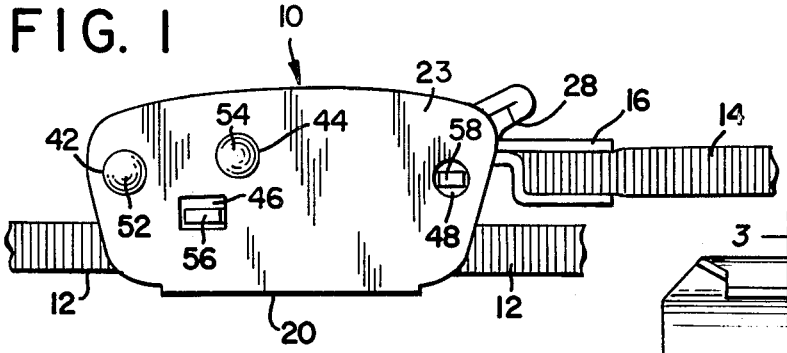
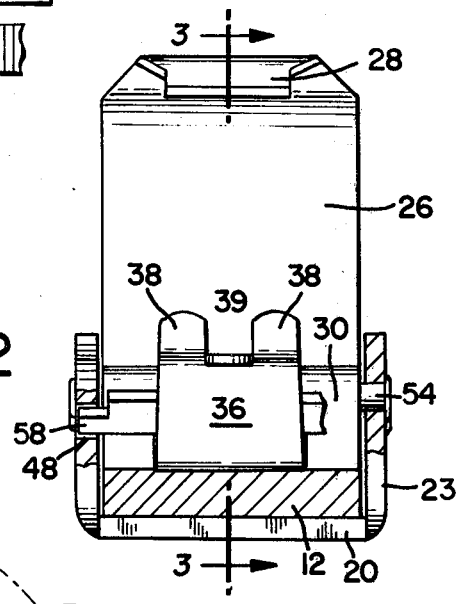
FIG. 2
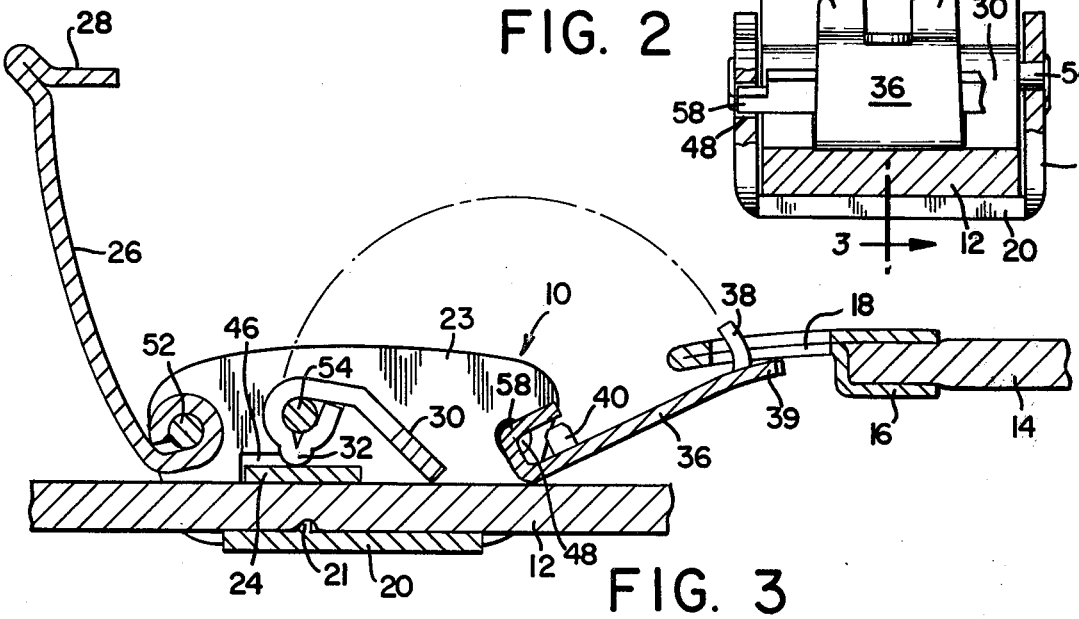
FIG. 3
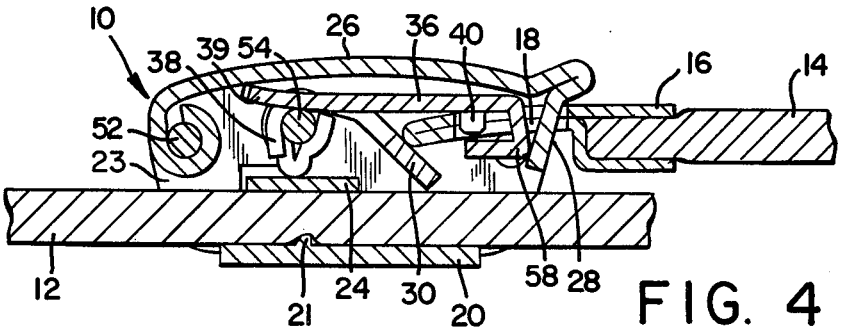
FIG. 4

United States Patent [19]

Learn

[11] 4,158,904

[45] Jun. 26, 1979

[54] CLASP ASSEMBLY

[75] Inventor: Richard D. Learn, South River, N.J.

[73] Assignee: Duchess Mfg. Corp., Hoboken, N.J.

[21] Appl. No.: 883,491

[22] Filed: Mar. 6, 1978

[51] Int. Cl.[2] ..... A44B 11/25

[52] U.S. Cl. ..... 24/78; 24/265 WS; 24/191

[58] Field of Search ..... 24/79, 77 R, 78, 69, 24/71 J, 170, 191, 265 WS, 68 SB, 68 AS, 68 J, 68 E

[56] References Cited

U.S. PATENT DOCUMENTS

| | | | |
|---|---|---|---|
| 1,636,869 | 7/1927 | Schaefer | 24/69 J |
| 3,425,104 | 2/1969 | Mochizuki | 24/265 WS |
| 3,711,906 | 1/1973 | Leon | 24/78 |
| 3,795,028 | 3/1974 | Weiss | 24/78 |
| 3,797,716 | 3/1974 | Mochizuki | 24/78 |

*Primary Examiner*—Kenneth J. Dorner

*Attorney, Agent, or Firm*—Kirschstein, Kirschstein, Ottinger & Cobrin

[57] ABSTRACT

A clasp construction for use in adjustably interconnecting the free ends of a band on the wrist of a wearer, including a clamp assembly that receives one of the free ends of the band therein in slidable, adjustable relation and an eye member that is secured to the other free end of the band, the eye member engaging the clasp assembly via a positively locking, tongue member pivotly mounted within the clasp assembly for removably mounting the band on the wrist of a wearer.

10 Claims, 11 Drawing Figures

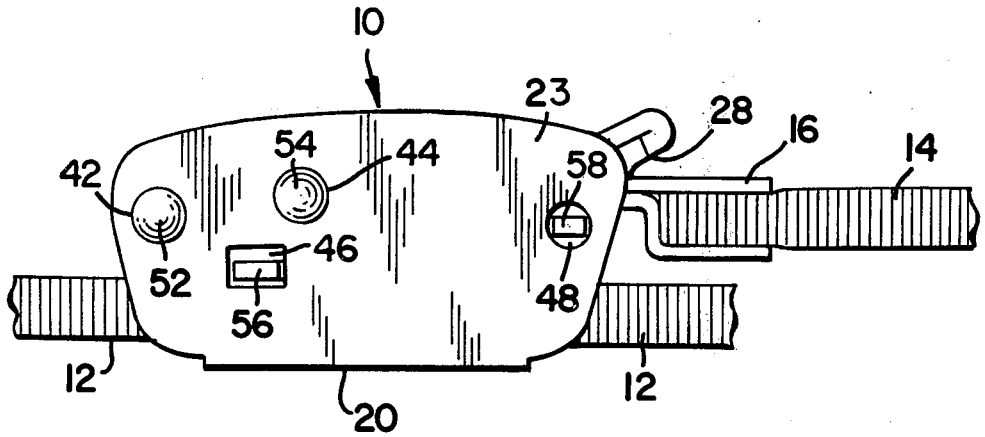

CLASP ASSEMBLY

BACKGROUND OF THE INVENTION

1. Field of the Invention

This invention relates to a band clasp construction, and particularly a clasp construction for adjustably safety-locking a wrist watch band or bracelet on the wrist of a wearer.

2. Description of the Prior Art

Various clasp constructions are known in the prior art for holding opposite ends of a band therein. Generally, one of the free ends of a band is held in slidable, adjustable relation within the clasp assembly via a locking cam and a coupling assembly secured to the other free end of the band engages the clasp assembly for removably mounting the band on the wrist of a wearer. For example, in U.S. Pat. No. 3,425,104 a looped eye member serves as the coupling assembly and engages a hook situated on a fixed and immobile locking member within the clasp assembly. In U.S. Pat. No. 3,795,028, another clasp constructions of this type, spring loaded levers fixed within the clasp assembly are employed which levers friction fit against a hook which serves as the coupling assembly. Other clasp constructions of this type are shown in U.S. Pat. Nos. 2,184,319; 2,229,677; 3,795,028; and 3,797,716.

However, the prior act clasp constructions had certain deficiences. These included undesirable features such as being able to accidentally open and disengage from the wrist of the wearer, being difficult to manipulate by use of fingers and/or having to be over-tensioned to properly fit on the wrist of a wearer. The latter disadvantage arose when the coupling assembly secured to one end of the band was initially lockably engaged with the clasp assembly as a wearer placed the band on his/her wrist. The coupling assembly engaging member was fixed and/or immobile relative to the coupling assembly. Consequently, in these arrangements the coupling assembly had to be manually drawn toward and beyond the fixed coupling assembly engaging member before positive engagement therewith could be established. To fit a watch band comfortably on the wrist of a wearer using these arrangements, it was therefore necessary to overtension the band on the wrist (i.e.) narrow its diameter.

SUMMARY OF THE INVENTION

1. Purposes of the Invention

Accordingly, one or more of the following objects will be achieved by the practice of this invention:

It is an object of this invention to provide an improved clasp construction for adjustably interconnecting the free ends of a band on the wrist of a wearer.

Another object of this invention is to provide an improved clasp assembly including a coupling assembly comprised of an eye member and tongue member which couple together in a positive locking engagement.

Still another object is to provide a clasp which facilitates putting a wrist watch band or bracelet on a wearer's arm in a simple and comfortable manner.

An object of this invention is to provide a clasp assembly including a pivotably mounted member for positively lockably engaging with an eye member secured to one end of a band when the tongue member is snapped into its closed position within the clasp assembly.

A further object is to provide a clasp assembly which does not have to be overtensionsed before becoming safety-locked on the wrist of a wearer.

Still another object is to provide a clasp assembly including a pivotly mounted, tongue member adapted to both pivot outside of the clasp assembly for initially engaging an eye member secured to one end of a band and also to pivot back inside the clasp assembly for positively locking the eye member engaged therewith to the clasp assembly.

It is also an object of this invention to provide a clasp assembly which positively lockably engages the free ends of a band and will not accidentally open.

Another object is to provide a clasp assembly for removably mounting a band on the wrist of a wearer which assembly may be easily opened and closed by the action of fingers.

These and other objection will readily become apparent to those skilled in the art in the light of the teachings hereinafter set forth.

2. Brief Description of the Invention

In the present invention, an improved clasp assembly is provided of the type having a clamp assembly that receives one of the free ends of a band therein in slidable, adjustable relation and a coupling assembly that is secured to the other free end of the band, the coupling assembly including a coupling member that engages the clamp assembly for removably mounting the band on the wrist of a wearer. The improvement basically entails a combination of structural elements.

A clasp assembly is provided according to this invention, for adjustably interconnecting opposite sections of a band on the wrist of a wearer in a positive locking arrangement. The clasp assembly includes an enclosure means comprised of a base plate having an upwardly extending tooth member on its upper surface and oppositely facing side walls. A free end portion of a band may be positioned by sliding action along the upper surface of the base plate. Above the upper surface of the base plate and extending to end connection with the side walls are a plurality of pins. A first one of the pins is adapted to hold a first locking member and a second one of the pins is adapted to hold a cover member. A bearing plate and a tongue member are pivotably mounted to the side walls via their respective axles situated at one end of the bearing plate and tongue member respectively which axles extend to respective end connections with the side walls.

The combination of bearing plate, first locking member and base plate form a first locking means of the clasp assembly. A proximate end of the first locking member is pivoted mounted on a first one of said support pins, as previously mentioned, said end including two grip means to engage the upper surface of the bearing plate when the first locking member is pivoted in a downward direction to a predetermined position. In turn, the bearing plate is pivotably mounted within the enclosure means about its axis and is pivotable into a locking position when the first locking member is in its predetermined position. The band portion resting on the base plate is then firmly held between the bearing plate and base plate at the point to which it is adjusted.

An elongated tongue member is formed with downwardly extending latching fingers at its distal (free) end, to enter a recess between the two grip means and positively lockably engage, by its latching fingers, the first support pin. Between the downwardly extending latching fingers, there is an upwardly extending finger catch for lifting and thereby disengaging the positively locking tongue member from its positively locked position. At the pivot end of the tongue member, there are formed downwardly extending latching legs for limiting slidable rearward movement of an eye member along the length of the tongue member toward its (pivot) proximate end.

The tongue member is adapted to couple with an eye member secured to the other end of the band. Pivotably mounted about an axle at its back end, the tongue member is rotable between an open, unlocked position and a closed, locked position. In its open unlocked position, the distal (front) end of the tongue member may extend outside of the enclosure means. In its closed locked position, the latching fingers at the distal end of the tongue member snap over the first support pin, positively lockably securing the tongue member with the first support pin. When the tongue member is in its open position, the eye member may be coupled thereto by sliding the eye member over and along the longitudinal length of the tongue member until it abuts the latching legs thereof.

The cover member is pivotly mounted on a second one of the support pins spaced apart from the first one. The distal (free) end of the cover member has an upwardly extending lip which terminates in a downwardly extending tab adapted to snugly snap into the eye of the eye member and abut the (pivot) proximate end of the tongue member when the cover member is pivoted over the clasp assembly into a closed position. When the eye member is positively lockably coupled to the tongue member in its closed position, slidable rearward movement of the eye member along the longitudinal length of the tongue is prevented by the latching legs of the tongue member, as previously mentioned. Forward slidable movement of the eye member along the longitudinal length of the tongue member is limited when the tab of the cover member snaps into and substantially fills the eye of the eye member in the closed positions of the cover member and tongue member, respectively. Also, in its closed position, the lower surface of the cover member abuts the upwardly extending finger catch of the tongue member bearing downward pressure thereon which serves to further positively safety-lock and protect the clasp assembly from inadvertent or accidental opening. Positive action is required to open the cover member, i.e., by upward lifting of the lip of the cover member.

The invention accordingly consists in the features of construction, combination of elements and arrangement of parts which will be exemplified in the clasp assembly hereinafter described and of which the scope of application will be indicated in the appended claims.

BRIEF DESCRIPTION OF THE DRAWINGS

For a better understanding of the present invention, reference should be had to the accompanying drawings wherein like numerals of reference indicate similar parts throughout the several views and wherein:

FIG. 1 is a side elevation view of the clasp assembly of this invention.

FIG. 2 is a front elevation view of the clasp assembly of this invention with the cover member in an open position.

FIG. 3 is a side cross-sectional view of the clasp assembly of this invention taken along line 3—3 of FIG. 2 with the tongue member in an open position.

FIG. 4 is a side cross-sectional view of the clasp assembly of this invention taken along line 3—3 of FIG. 2 with the cover and tongue members in a closed position.

DETAILED DESCRIPTION OF THE PREFERRED EMBODIMENTS

Figures 5, 6, 7, 8, 9, 10, 11:
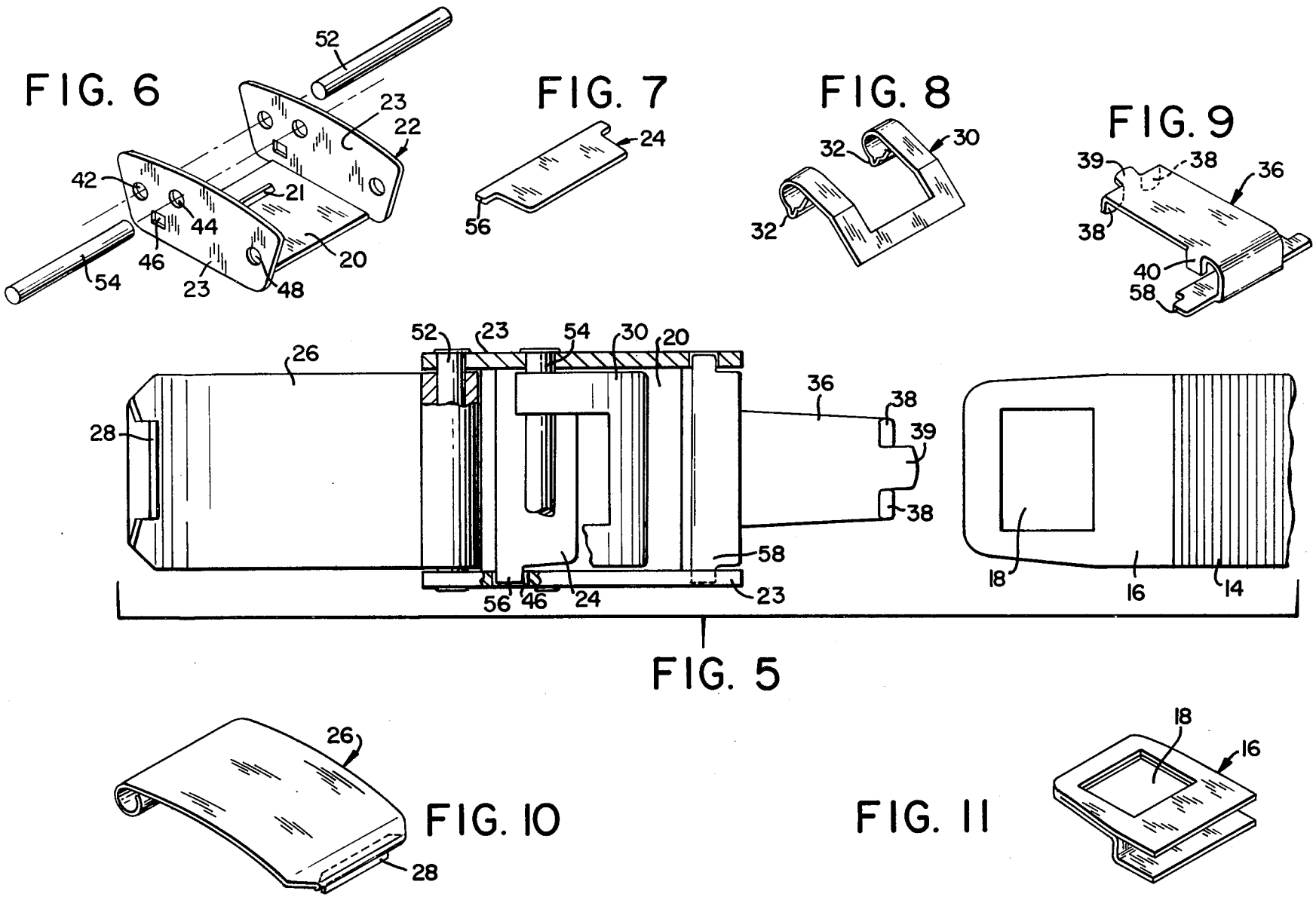
FIG. 5 is a plan view of the clasp assembly of this invention partly in cross-section showing the eye member secured to a free end of a band in an uncoupled position and the tongue member of the clasp assembly in an open position.
FIG. 6, FIG. 7, FIG. 8, FIG. 9, FIG. 10 and FIG. 11 are perspective views of a base member, a bearing plate, a locking member, a tongue member, a top cover member and an eye member, respectively.

Referring now to the Figures, there is shown an enclosure means 22, a bearing plate 24, a locking member 30, a tongue member 36, a cover member 26 and an eye member 16, all of them being comprised of a ductable bendable, die cuttable metal such as sheet metal or the like. Suitable metals include gold, silver, stainless steel and the like.

As shown in FIGS. 3 and 6, enclosure means 22 is comprised of a base plate 20 having an upwardly extending tooth member 21 on its upper surface and oppositely facing side walls 23. The U-shaped, box-like, enclosure means 22 of the clasp assembly of this invention is conventional except for the number and placement of holes in the oppositely facing side walls 23 thereof.

Referring to FIGS. 1 and 6, there are four holes in each of the side walls 23 for receiving pins, axles which support members within enclosure means 22. There are two round, pin-receiving holes in the upper half of each side wall 23 at one end thereof. Of the two holes, hole 42 is the more exteriorly situated on each side wall 23, i.e., closer to one end of each side wall 23, whereas hole 44 is more interiorly situated on each side wall 23. A third round, pin receiving hole 48 is situated at the other end of each side wall in the upper half thereof. An axle receiving hole 46 shown as rectangularly shaped in the Figures is situated between and below round holes 42 and 44 in the lower half of each side wall 23.

Referring particularly to FIGS. 1, 5 and 7 there is shown bearing plate 24 having an axle 56 which fits within rectangular holes 46 in each of the side walls 23 of the enclosure means 22. Bearing plate 24 is substantially planar and dimensioned so that its lateral edges substantially abut the side walls 23 of enclosure means 22 and prevent lateral movement of the bearing plate therebetween. The thickness of bearing plate 24 may be varied. It should be proportionately increased with increases in the thickness of the band or bracelet upon which it exerts pressure.

Referring now to FIG. 8, there is shown locking member 30 which preferably is a cam lock. One end portion thereof is downwardly folded to form two separate, pin-receiving sleeves. The other end of the locking member forms a flat bar. The locking member 30 itself is somewhat U-shaped with a bar end and a lobe end having two lobes (sleeves). Each of the lobes sleeves) includes a grip means 32 to engage the upper surface of bearing plate 24 when the locking member 30 is rotated in a downward direction to a predetermined closed position.

Locking member 30 is supported within the enclosure means 22 by means of a pin 54 (FIG. 6) within holes 44 and through the two sleeves of the locking member 30

(FIGS. 3, 4 and 8). Pin 54 supports locking member 30, and serves as a pivotpoint for its bearing surface, i.e., when pressure is applied to the bar end of the locking member 30 in a downward direction, the bar end rotates to a closed position (See FIGS. 3 and 4). In this closed position, pressure is applied by the bearing surfaces 32 of the locking member 30 onto the bearing plate 24 causing it to orient parallel to the base plate 20 of the enclosure means.

In FIG. 9, there is shown tongue member 36 which extends downwardly at its proximate end and folds back toward its distal end forming a rear axle 58 which extends through hole 48 of the side walls 23 of the enclosure means 22. The lateral edges of axle 58 are dimensioned so that one part can fit into holes 48 of side walls 23 and the other part thereof substantially abut the side walls 23 limiting lateral movement of the tongue member within enclosure means 22. At the distal end thereof, tongue member 36 is provided with two mutually space downwardly extending latching fingers 38 and an upwardly extending finger catch 39 therebetween. At the pivot/proximate end of tongue member 36, there is formed downwardly extending latching legs 40.

Referring now to FIG. 10, the rectangular cover member 26 is generally convexly shaped. One rectangular proximate end thereof is downwardly folded to form a pin-receiving sleeve. Cover member 26 is pivotly mounted on pin 52 which passes through its pin receiving sleeve and holes 42. (FIGS. 3, 5 and 6) the distal end of cover member 26 has an upwardly extending fold defining a finger catch which extends to a downward extending tab.

As shown in FIG. 11, eye member 16 is generally rectangularly shaped. Its upper right portion has an eye 18, shown as rectangularly shaped, through which both tongue member 36 and tab 28 of cover member 26 fit. The lower right portion of eye member 16 has upper and lower flat flanges in parallel alignment which flanges serve to secure a free end portion of the band therebetween and to eye member 16.

In operation, a free and part 12 of a band such as a leather or metal mesh wrist watch band, two parts of which are respectively secured to both sides of a wristwatch, is slidably adjustably received between the base plate 20 of the enclosure means 22 and the bearing plate 24 (FIGS. 3 and 4). The other end 14 of the band is rigidly secured to the lower portion of eye member 16. When downward pressure is applied to the bar end of the locking member 30, it rotates downward and grip means 32 presses against bearing plate 24, which in turn, presses against an obverse side of the band 12 pushing the band toward the upper surface of base plate 20 of the enclosure means 22. At the upper surface of base plate 26, tooth 21 projects outwardly upward and into the reverse side of the band 12. When tooth mating notches or recesses are provided in the reverse side of the band, the band is then slidably received in the enclosure means for discrete adjustments (between adjacent notches/recesses). The locking engagement of tooth member 21 into such recess is a positive one. Absent such notches, adjustments can be made at any point along the entire band. In the closed position of locking member 30, band 12 is captured and fixed between bearing plate 24 and base plate 20 thereby locking the clasp assembly onto the adjustable end of the band.

Both the locking cover member 26 and tongue member 36 can pivot about 180° or more about their respective pivot points between open and closed positions, as shown in FIGS. 3 and 4. Locking cover member 26 and tongue member 36 are pivotable in opposite senses of rotation about their respective proximate ends between respective open positions wherein their respective distal ends are situated outside of said enclosure means and respective closed positions wherein their respective distal ends are situated within the enclosure means. For example if locking cover member 26 is pivotable clockwise to an open position, then tongue member 36 would be pivotable counterclockwise to reach its open position and vice versa.

When both tongue member 36 and cover member 26 are in their respective open positions, the free, (distal) front end of members 36 and 26, respectively, may extend outside of the enclosure means 22. Preferably, they are each pivotable, between about 120° and about 180° into their respective open positions. Eye member 16 may be coupled to the tongue member 36 by sliding the eye 18 of eye member 16 over and along the longitudinal length of tongue member 36 until it abuts the latching legs 40 thereof. Tongue member 36 may then be pivoted back into its closed position where it is substantially in parallel alignment with base plate 20 of enclosure means 22. In such closed position, the front legs 38 (see FIGS. 2–4) of tongue member 36 provide friction surfaces which snap over center pin 54 (which passes through interiorly situated hole 44) and positively lockably engage tongue member 36 to pin 54).

The latching legs 40 limit slidable rearward movement of eye member 16 along the longitudinal length of tongue member 36 toward its pivot (proximate) end. In addition, latching legs 40 serve to prevent tab 28 of cover member 26 from entering a void space between the axle and the downwardly folded proximate end of tongue member 36. If such entry occurred, it would be difficult to disengage cover member 26 manually without bending or distorting it and/or tongue member 36. Moreover, latching legs 40 abut a front (distal) end of eye 18 of eye member 16 which serves to position eye member 16 so that tab 28 of cover member 26 can snap into a space in eye 18 between the proximate end of tongue member 36 and the rear (proximate) end of eye 18 of eye member 16, as subsequently described.

After eye member 16 is positively lockably coupled to tongue member 36 in its closed position, cover member 26 may be pivoted into its closed position which also is substantially in parallel alignment with base plate 20. In its closed position, tab 40 snaps into and substantially fills the balance of the space within eye 18 of eye member 16 not already taken up by tongue member 36. This, in effect, limits forward slidable movement of eye member 16 along the longitudinal length of tongue member 36 thereby locking eye member 16 into a predetermined fixed position within the clasp assembly of this invention.

Furthermore, when cover member 26 is in its closed position, its lower surface abuts the upwardly extending finger catch 39 of member 36 bearing downward pressure thereon. This serves to further to positively safety lock the clasp assembly and prevent it from accidentally opening. Another important safety lock feature is provided by the front latching fingers 39 of tongue member 36. The latching fingers 39 are curved to provide a further positive locking action which substantially prevents accidental removal of eye member 16 from tongue member 36. When the band is removed from the wrist, eye member 16 slides along the length of tongue member 36 toward its "snap" distal end before disengaging.

The latching fingers 39 at the "snap" distal end engage eye member 16 and prevent it from accidentally sliding off tongue member 36. A positive lifting action or movement is required to disengage eye member 16 from the latching fingers 38 of member 36.

When eye member 16 is coupled with tongue member 36, the diameter of the band is shortened into its desired wearing diameter. This is unlike prior art devices wherein the eye member 16 or its equivalent had to be moved toward a fixed hook or the like a distance greater than that required to achieve a desired wearing diameter in order to couple with the hook. According to the clasp assembly of the present invention, the diameter of the band is adjustably shortened from a diameter greater than the desired wearing diameter on the wrist of a wearer to, but not beyond, the desired wearing diameter.

Both the cover member 26 and tongue member 36 have finger latches 28 and 39 respectively (FIGS. 1–5) for facilitating the lifting of the respective members out of their respective closed positions and decoupling the eye member 16 and tongue member 36. Releasing the clasp assembly is, of course, easily accomplished by reversing the steps of locking it; in order to release the band from the wrist of a wearer. However, the various safety lock features enumerated hereinabove which provide positive locking action necessitate positive actions to unlock the clasp assembly, i.e., lip 28 of cover member 26 and latch 39 of tongue member 36 must be lifted by positive action to uncouple the clasp assembly. It thus will be seen that there is provided a clasp assembly which achieves the various objects of the invention and which is well adapted to meet the conditions of practical use.

As various embodiments might be made of the above-described invention, and as various changes might be made in the embodiment set forth, it is to be understood that all matter herein described or shown in the accompanying drawings is to be interpreted as illustrative and not in a limiting sense. Thus, it will be understood by those skilled in the art that although preferred and alternative embodiment have been shown and described in accordance with the Patent Statutes, the invention is not limited thereto or thereby.

Having thus described the invention, there is claimed as new and as desired to be secured by Letters Patent:

1. In a clasp assembly for adjustably interconnecting the free ends of a band on the wrist of a wearer, the clasp assembly having:

(A) an enclosure means capable of receiving a free end portion of said band in slideable adjustable relation, said enclosure means including a base member and oppositely facing side walls;

(B) first locking means including a locking member pivotably mounted within said enclosure means for lockably engaging a free end portion of said band within said enclosure means;

(C) an eye member secured to the other end of said band, said eye member having an eye;

(D) second locking means for lockably engaging said eye member within said enclosure means the improvement in (D) which comprises:

(i) said second locking means comprising an elongated tongue member and a cover member, said tongue member and said cover member each having a proximate and a distal end;

(ii) said eye of said eye member capable of sliding over and along the longitudinal length of said tongue member;

(iii) both said tongue member and said cover member being pivotably mounted within said enclosure means at substantially opposite ends thereof and pivotable in opposite senses of rotation about their respective proximate ends between respective open positions wherein their respective distal ends are situated outside of said enclosure means, (iv) said tongue member including means for positively locking in its closed position and for limiting slideable movement of said eye member in a rearward direction toward the proximate end of said tongue member along its longitudinal length, (v) said cover member including means for positively locking in its closed position and for limiting slideable movement of said eye member in a forward direction toward the distal end of said tongue member along its longitudinal length, the combination of said tongue member and said cover member operating, in their respective closed positions, to fixably secure said eye member within said enclosure means.

2. A clasp apparatus as defined in claim 1 wherein said enclosure means further includes a plurality of support pins mounted between said side walls, said first locking means being pivotably mounted on a first one of said pins, and wherein said positive locking means of said tongue member comprises at least one downwardly extending latching finger at its distal end capable of positively engaging said first one of said pins in the closed position of said tongue member.

3. A clasp apparatus as defined in claim 1 wherein said slideable movement limiting means of said tongue member comprises at least one downwardly extending latching leg in the vicinity of its proximate end.

4. A clasp apparatus as defined in claim 1 wherein said positive locking and slideable movement limiting means of said cover member comprises a downwardly extendng tab at its distal end capable of positively lockably engaging the proximate end portion of said tongue member while extending into and filling said eye of said eye member in conjunction with said tongue member in the respective closed positions of said cover member and said tongue member.

5. A clasp assembly as defined in claim 1 wherein said tongue member and said cover member are each pivotable between about 90° and about 180°.

6. A clasp assembly as defined in claim 1 wherein said tongue member further includes an upwardly extending finger catch at its distal end for lifting said tongue member out of its positively lockably engaged closed position.

7. A clasp assembly as defined in claim 6 wherein the cover member has a lower surface which contacts said upwardly extending finger catch of said tongue member in the respective closed positions of said cover member and said tongue member.

8. A clasp assembly as defined in claim 1 wherein said cover member further includes an upwardly extending fold at its distal end defining a finger catch for lifting said cover member out of its positively lockably engaged closed position.

9. In a clasp assembly for adjustably interconnecting the free ends of a band on the wrist of a wearer, the clasp assembly having:

(A) an enclosure means capable of receiving a free end portion of said band in slideable adjustable relation, said enclosure means including a base member and oppositely facing side walls, (B) first locking means including a locking member pivotably mounted with said enclosure means for lockably engaging a free end portion of said band within said enclosure means, (C) an eye member secured to the other end of said band, said eye member having an eye, (D) second locking means for lockably engaging said eye member within said enclosure means, the improvement in (D) which comprises:

(i) said second locking means comprising an elongated tongue member and a cover member, said tongue member and said cover member each having a proximate and a distal end, (ii) said eye of said eye member capable of sliding over and along the longitudinal length of said tongue member, (iii) said enclosure means further including a plurality of support pins mounted between said side walls, said first locking means being pivotably mounted on a first one of said pins, (iv) both said tongue member and said cover member being pivotably mounted within said enclosure means at substantially opposite ends thereof and pivotable between about 90° and about 180° in opposite senses of rotation about their respective proximate ends between respective open positions when their respective distal ends are situated outside of said enclosure means and respective closed positions wherein their respective distal ends are situated within said enclosure means, (v) said tongue member comprising at least one downwardly extending latching finger at its distal end capable of positively engaging said first one of said pins in the closed position of said tongue member, (vi) said tongue member further comprising at least one downwardly extending latching leg in the vicinity of its proximate end for limiting slideable movement of said eye member in a rearward direction toward the proximate end of said tongue member along its longitudinal length, said tongue member further including an upwardly extending finger catch at its distal end for lifting said tongue member out of its positively lockably engaged closed position, (vii) said cover member comprising an upwardly extending fold at its distal end defining a finger catch for lifting said cover member out of its closed position, said fold extending into a downwardly extending tab capable of positively lockably engaging the proximate end of said tongue member while extending into and filling said eye of said eye member in the respective closed positions of said cover member and said tongue member, which positive lockable engagement serves to limit slideable movement of said eye member in a forward direction toward the distal end of said tongue member along its longitudinal length, said cover means having a lower surface contacting said upwardly extending finger catch of said tongue member in the respective closed positions of said cover member and said tongue member, (viii) the combination of said tongue member and said cover member operating, in their respective closed positions, to fixably secure said eye member within said enclosure means.

10. A clasp assembly for adjustably interconnecting the free ends of a band on the wrist of a wearer, which clasp assembly comprises:

(A) an enclosure means including a base member and oppositely facing side walls, said enclosure means being capable of receiving a free end portion of said band in slideable adjustable relation;

(B) first locking means including a locking member pivotably mounted within said enclosure means for lockably engaging a free end portion of said band within said enclosure means, and (C) second locking means for positively lockably engaging an eye member secured to the other end of the band within said enclosure means, said eye member having an eye capable of sliding over and along the longitudinal length of an elongated tongue member;

(i) said second locking means comprising an elongated tongue member and cover member, said tongue member and said cover member each having a proximate end and a distal end, (ii) both said tongue member and said cover member being pivotably mounted within said enclosure means at substantially opposite ends thereof and pivotable in opposite senses of rotation about their respective proximate ends between respective open positions wherein their respective distal ends are situated outside of said enclosure means and respective closed positions wherein their respective distal ends are situated outside of said enclosure means, (iii) said tongue member including means for positively locking in its closed position and for limiting slideable movement of said eye member in a rearward direction toward the proximate end of said tongue member along its longitudinal length, (iv) said cover member including means for positively locking in its closed position and for limiting slideable movement of said eye member in a forward direction toward the distal end of said tongue member along its longitudinal length, the combination of said tongue member and said cover member operating, in their respective closed positions, to fixably secure said eye member within said enclosure means.

* * * * *